US006614009B2

(12) United States Patent
Gershtein et al.

(10) Patent No.: US 6,614,009 B2
(45) Date of Patent: Sep. 2, 2003

(54) HIGH FLOW RATE TRANSPORTABLE UHP GAS SUPPLY SYSTEM

(75) Inventors: Vladimir Yliy Gershtein, Allentown, PA (US); Alexandre De Almeida Botelho, Bethlehem, PA (US); Bruce H. Greenawald, Schnecksville, PA (US); Mark A. Lusignea, Schnecksville, PA (US); Kevin J. McMahon, Allentown, PA (US); Robert William Ford, Schnecksville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 131 days.

(21) Appl. No.: 09/966,197

(22) Filed: Sep. 28, 2001

(65) Prior Publication Data

US 2003/0062361 A1 Apr. 3, 2003

(51) Int. Cl.[7] ..... H05B 3/02

(52) U.S. Cl. ..... 219/486; 219/497; 392/416; 392/394

(58) Field of Search ..... 219/486, 497, 219/121.43, 483

(56) References Cited

U.S. PATENT DOCUMENTS

| | | | | | |
|---|---|---|---|---|---|
| 2,166,922 | A | * | 7/1939 | White | 392/394 |
| 2,348,546 | A | * | 5/1944 | Kercher | 137/341 |
| 4,255,646 | A | * | 3/1981 | Dragoy et al. | 392/396 |
| 4,645,904 | A | * | 2/1987 | Moraski et al. | |
| 6,025,576 | A | | 2/2000 | Beck et al. | 219/521 |

* cited by examiner

*Primary Examiner*—Tu Ba Hoang
(74) *Attorney, Agent, or Firm*—Geoffrey L. Chase

(57) ABSTRACT

A high flow rate, transportable, ultra high purity gas vaporization and supply system is provided which includes a vessel suitable for carrying large quantities of a liquefied gas, valves to operate with liquid or gas phases, a loading/unloading unit disposed on the vessel for loading and unloading the liquefied gas to be supplied, and a heater containing heating elements permanently positioned on the vessel to supply energy into the liquefied gas. The heater causes the liquefied gas to be supplied through the loading/unloading unit as a gas. A heater controller is also provided which uses process variables feedback for regulating the heating elements to maintain and regulate gas output.

16 Claims, 4 Drawing Sheets

HIGH FLOW RATE TRANSPORTABLE UHP GAS SUPPLY SYSTEM

BACKGROUND OF THE INVENTION

The present invention relates to a gas supply system. More particularly, the present invention is directed to the supply of ultra high purity gases in large volumes and at high flow rates from a container of liquefied gas.

The growth of electronic and fiber-optic industries has created a demand for a supply of large quantities of ultra high purity (UHP) gases. Historically, UHP gases were shipped to consumers in cylinders, Y-cylinders (see discussion below), and toners. The increasing demand for UHP gases has shown that use of small and mid-size vessels is no longer adequate. Therefore, large vessels such as tube trailers, ISO (International Standards Organization) containers, tankers, and the like, are considered more viable.

ISO containers have long been a standard vehicle for transporting equipment and other goods via air, land, sea, and rail. These containers are durable, rugged in construction, and are sized and shaped such that they are readily and economically securable to rail cars, trucks, ship holds, and cargo bay floors of large aircraft. These freight containers are of standard dimensions, and are used in international transport whether by land, sea or air. Additionally, these containers are provided with corner fittings which may be used both to lift the container, and also to lock it to a vehicle on which it is being transported. The dimensions of these containers are laid down by the International Organisation for Standardisation, and they are accordingly referred to as ISO containers.

The purity of the delivered gases is the most critical factor of the bulk gas delivery system. UHP gases must meet very stringent specifications for moisture, metal content, particles, and the like. For example, 1 part per million (ppm) moisture content in the gas phase is often considered to be the maximum moisture level permissible for a gas used in high technology industries. The problem with bulk UHP gas delivery systems is enhanced by the fact that there is little experience in the industry in the use and preparation of large size containers.

Typically, a UHP gas delivery system is divided into two major parts. The first part is a vessel, which stores and delivers a liquefied gas. The second part is vaporizer, which vaporizes liquid, supplying the gas phase to a distribution system. Each part of the described gas delivery system is independent from the other. As noted above, a major concern associated with such a system is gas purity. Vaporizers may become an additional source for gas contamination. In addition, vaporizers typically take a lot of space and may be quite costly.

One attempt made to eliminate a vaporizer and to deliver the gas phase directly from the vessel is described in U.S. Pat. No. 6,025,576 (Beck et al.) for a bulk vessel heater skid for liquefied compressed gases. This patent addresses a problem where compressed gases are dispensed from cylinders, as follows. As the high pressure gases are emitted from the cylinder, the expansion of the gases absorbs thermal energy which causes a cooling at the point of dispensation that propagates throughout the cylinder to cause an undesirable cooling of the cylinder walls and of the gases within the cylinder. Cooling at the valve or regulator can cause frosting that creates other problems with gas flow in the overall system. Where the gases are compressed and liquefied within the cylinder, the evaporation of liquid to gas also causes cooling of the liquid, gas and cylinder. This causes the cylinder pressure (vapor pressure) to drop. The effect of the cooling is to reduce the maximum steady state flowrate that can be obtained from the cylinder. Extremely low temperatures can be created which can cause "embrittlement" of the cylinder that can result in a rupture and uncontrolled energy release from the highly pressurized cylinder. Moreover, such an energy release may be associated with flammable or combustible products.

The trend in industry is to require higher gas flow rates from larger cylinders which increases the cooling problems. By using larger cylinders of liquefied compressed gases, the supporting and maintenance of numerous small cylinders is eliminated and space is conserved. These larger cylinders are called "bulk vessels" or "tonnage containers." In particular, U.S. Pat. No. 6,025,576 addresses a popular type of bulk vessel such as the "Y" cylinder. The "Y" cylinder is approximately 24 inches in diameter by approximately 7 feet long and weighs about 1150 lbs., empty. Chemicals such as HCl and ammonia are commonly dispensed in bulk gas delivery systems using the "Y" cylinder. While the current demand is for gas flows in the range of 100–500 standard liters per minute (slpm), it is difficult to provide a rate higher than about 25 slpm for some gases because of the adverse effects from cooling in bulk gas delivery systems using the "Y" cylinder.

Various measures exist in the prior art for trying to maintain the temperature of a dispensing cylinder. One approach is to cover the cylinder in a thermal insulation material which helps to sustain the temperature of the cylinder. However, merely using insulation does not keep the cylinder at sufficiently high temperatures and may actually prevent ambient heat from heating the cylinder.

More effective is the use of heaters applied to the cylinder to alleviate the cooling effect resulting from the dispensing of gas. However, in the past, the cylinders were handled and stored by placement or attachment to skeletal frameworks, or "skids." This made it time consuming and cumbersome to attach heaters to the cylinder. Many of the transport skids provided little room to secure the heaters. The heaters must be attached when the cylinders are taken from a transport skid and placed onto a dispensing skid. The heaters must later be removed when the cylinder is exhausted and needs to be sent back for re-filling.

U.S. Pat. No. 6,025,576 teaches a skid with built in heating elements for heating and supporting a compressed-gas dispensing bulk vessel. A disadvantage of the system of U.S. Pat. No. 6,025,576 is that it has two substantial elements, the vessel and a separate heater skid. While this system may be applicable for mid-size cylinders such as Y-containers or toners, this system cannot feasibly be used for bigger vessels, such as ISO containers. If used with an ISO container, the skid would have a substantial weight if mounted together with the ISO container. This will reduce the container size to comply with transportation requirements. On the other hand, the ISO container cannot be placed on the skid, which is used as a stand-alone unit, due to the container frame structure. Therefore, a different system is needed.

An ideal system would satisfy the following requirements. First, the container should contain large quantities of liquefied gas (e.g., more than 2,000 lbs and up to about 20,000–50,000 lbs). Second, the system should be transportable around the world. Third, the system should have simple, safe, and easy connections when at an loading/unloading site. Fourth, the system should be capable of delivering high flow rates of UHP gases.

The present system addresses these requirements.

BRIEF SUMMARY OF THE INVENTION

The present invention is directed to a high flow rate, transportable, ultra high purity gas vaporization and supply system. The system includes a vessel suitable for carrying large quantities of a liquefied gas, a plurality of valves adapted to operate with liquid or gas phases, a loading/unloading unit disposed on the vessel for loading and unloading the liquefied gas to be supplied, and a heater containing heating elements permanently positioned on the vessel to supply energy into the liquefied gas. The heater causes the liquefied gas to be supplied through the loading/unloading unit as a gas. A heater controller is also provided which uses process variables feedback for regulating the heating elements to maintain and regulate gas output.

The vessel is preferably an ISO container, tube trailer, or tanker. The vessel is suitable for carrying over about 2,000 lbs. and up to about 20,000 to 50,000 lbs. of the liquefied gas. Preferably, the vessel is covered with thermal insulation. The heating elements may be divided into heating zones. The heater controller preferably utilizes temperature measurement elements to provide feedback to the heater controller and preferably includes a programmable logic controller to stagger activation of the heating elements. The heating elements are preferably connected to the heater controller utilizing quick-connect electrical plug assemblies to permit replacement of an empty vessel with minimal effort. The system preferably includes high temperature switches associated with the heating elements, wherein the switch includes a temperature set point where the switch disconnects associated heating elements when the set point is reached. The heating elements may be grouped into heating zones that are separately controlled by the heater controller. A ground-current leakage monitor that automatically disconnects power to the heating elements when leakage current exceeds a predetermined value, for example, 100 mA may be included. An over current limit device that automatically disconnects power to at least some heating elements when current exceeds a predetermined value may also be included. The heating elements are preferably located so as to minimize direct heating above the lowest expected vapor-liquid interface level. By doing so, gas phase purity is maximized.

A method for providing high flow rate, transportable, ultra high purity gas is also provided which includes providing the above system and then controlling flow of the gas out of the vessel through the loading/unloading unit by the heater controller utilizing process variables feedback to regulate the heating elements.

DETAILED DESCRIPTION OF THE INVENTION

Figure 1:
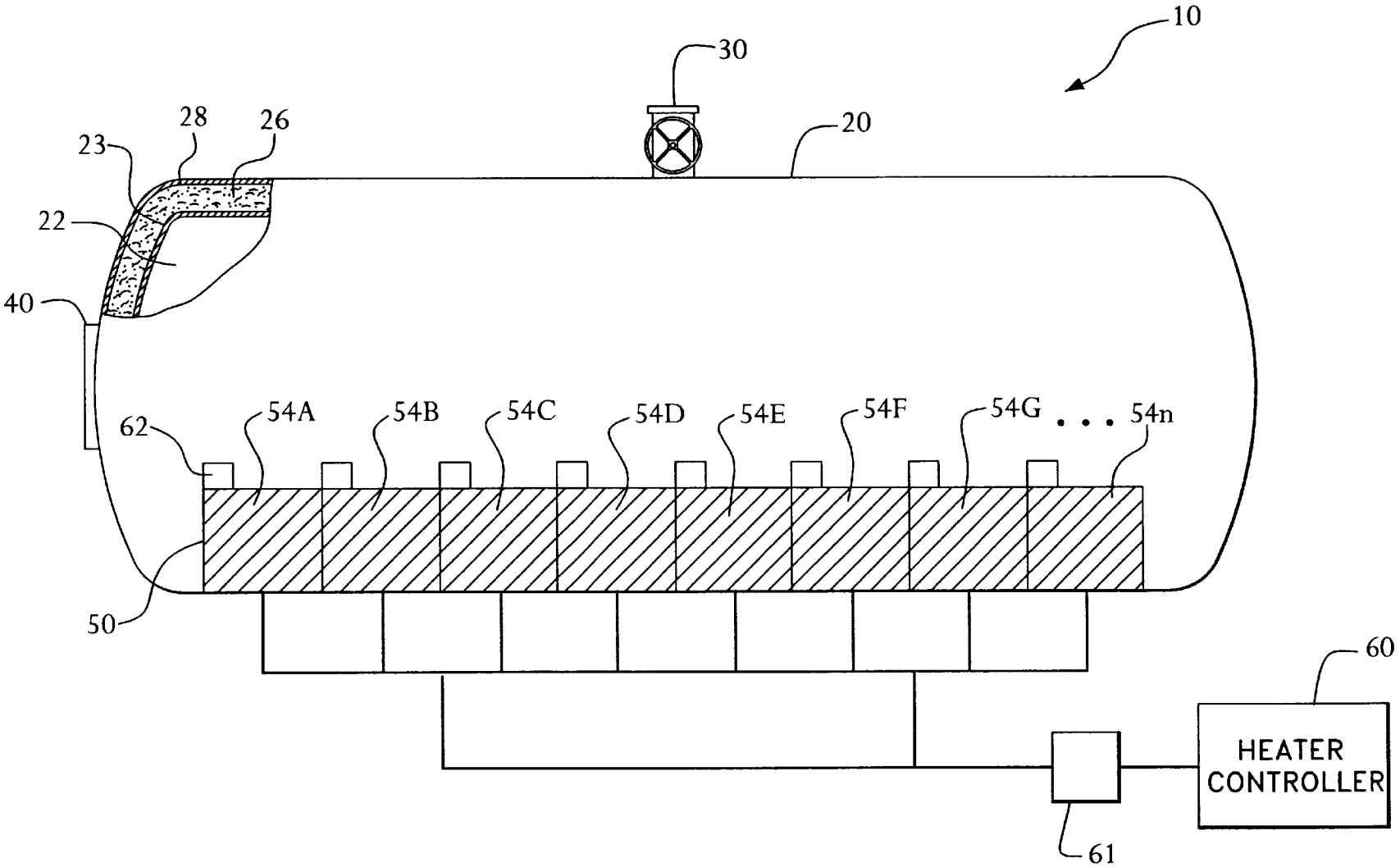
FIG. 1 is a simplified top, plan view of a high flow rate transportable UHP gas supply system in accordance with one preferred embodiment of the present invention.

Referring now to the drawings, wherein like part numbers refer to like elements throughout the several views, there is shown in FIG. 1 a high flow rate transportable UHP gas supply system 10 in accordance with one preferred embodiment of the present invention. The UHP gas supply system 10 preferably includes a vessel 20, a loading/unloading unit 30, a manway 40, at least one heater 50, a heater controller 60, insulation 26 and cladding 28.

As can be seen in FIG. 1, the vessel 20 is suitable for carrying large quantities of a liquefied gas. The vessel 20 is preferably designed for carrying more than about 2,000 lbs. and preferably about 20,000 to 50,000 lbs. Additionally, it is preferable that the vessel 20 be shippable all around the world, and is compliant with International Standards, e.g., ISO container standards.

The loading/unloading unit 30 includes an assembly of several valves for both liquid and gas phases. The loading/unloading unit 30 is preferably positioned at the top of the vessel 20 and used for loading and unloading operations. Here, a typical unit 30 may be bounded by solid walls and a lid at the top with rupture disk, pressure relief device (PRD), and/or pressure gauge.

One or more heaters 50 is permanently positioned on the vessel 20 and is used to supply energy in the form of heat into the liquefied gas within the internal volume 22 of the vessel 20. Preferably, the vessel heating system consists of the one or more heaters 50 and one or more heater controllers 60 that utilize process variables feedback for maintaining and regulating product output. The design criteria for the system are based on the requirement to introduce thermal energy to the surface 23 of the vessel 20 (e.g. an ISO Container) containing the liquefied gas. Sufficient energy must be delivered to the vessel surface 23 to vaporize the desired quantity of the product and to provide the specified flow requirements. The heater controller 60 prevents the surface temperature of the vessel 20 from ever exceeding a preset value even under abnormal operating conditions.

The one or more heaters 50 are preferably permanently attached to the outer surface 23 of the vessel 20 and are positioned between the outer surface 23 and vessel insulation 60. In the preferred embodiment, the heater 50 has at least one and preferably a plurality of heating elements (collectively reference number 54) (54A through 54*n*) and has resistance wires, thermocouples, grounding mesh, and an internal thermal fuse (not shown).

Figure 2:
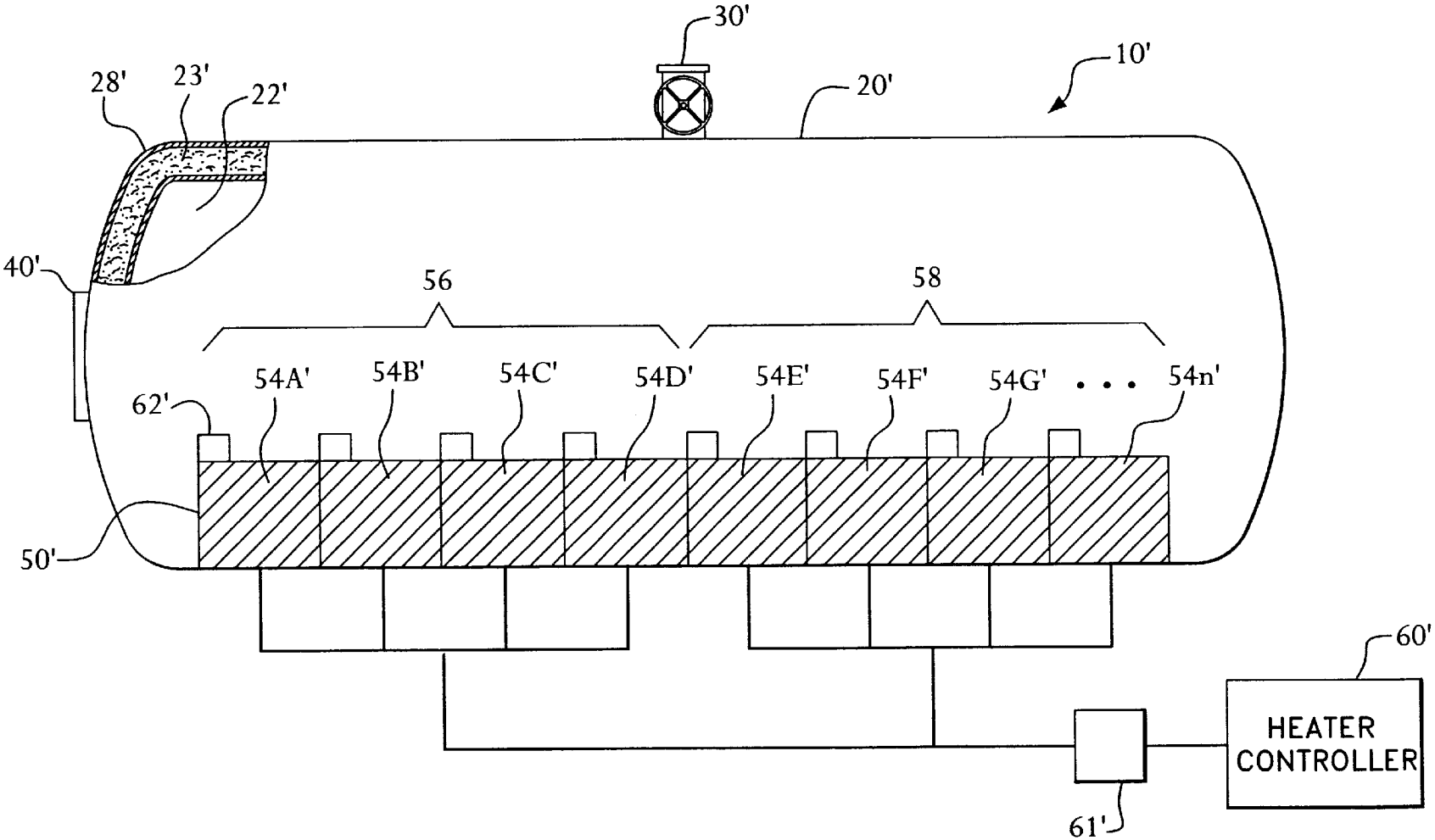
FIG. 2 is a simplified top, plan view of a high flow rate transportable UHP gas supply system in accordance with another preferred embodiment of the present invention.

As indicated, each heater 50 is preferably assembled out of a plurality of heating elements (or mats) 54. FIG. 2 depicts an alternate system 10' of the present invention. For the sake of convenience, like part numbers for like elements are used with respect to FIG. 2 as compared with those of FIG. 1, with an apostrophe thereafter. For example vessel 20 of FIG. 1 is substantially the same as vessel 20' of FIG. 2. However, for purposes of the present invention, the reference numbers of FIG. 1 and those of FIG. 2 can be considered interchangeable. As can be seen in FIG. 2, the heating elements 54' (54A' through 54*n'*) may form multiple heating zones 56, 58 with several heating elements. For example, 54A' through 54D' in one zone and 54E' through 54*n*' in a second zone. The elements 54' in one zone are preferably wired in a fashion which provides an even heat distribution over the surface of the vessel 23' in the event of one or several heating element 54' failures. The system 10 of FIG. 1 depicts the present invention utilizing a single zone while the system 10' of FIG. 2 depicts the present invention utilizing two separate zones 56, 58. Of course, more than two zones can be utilized and they need not be located on discrete sections of the vessel 20. That is, heating elements 54' of any single zone may be spread, for example, evenly over the bottom of the vessel 20'.

The heater controller 60 can be either a stand-alone unit or a part of the system mounted on a vessel frame. It is designed to provide a means to connect/disconnect power to the heating elements 54 and enable process variable(s) monitoring. One or more temperature measurement elements 62, e.g., thermocouples, may be used to provide feedback for the heater controller 60. The heater controller 60 is designed to regulate the heat energy input into the fixed volume of the horizontally mounted vessel 20 containing the liquefied product.

Due to the increase in scale over prior systems, the control scheme is defined in such a way as to minimize the impact on system operation due to failure of a single component. Independent control and protective layers are preferably integrated into the design to provide isolation of functionality and eliminate the possibility of a common mode failure between the layers.

Figure 4:
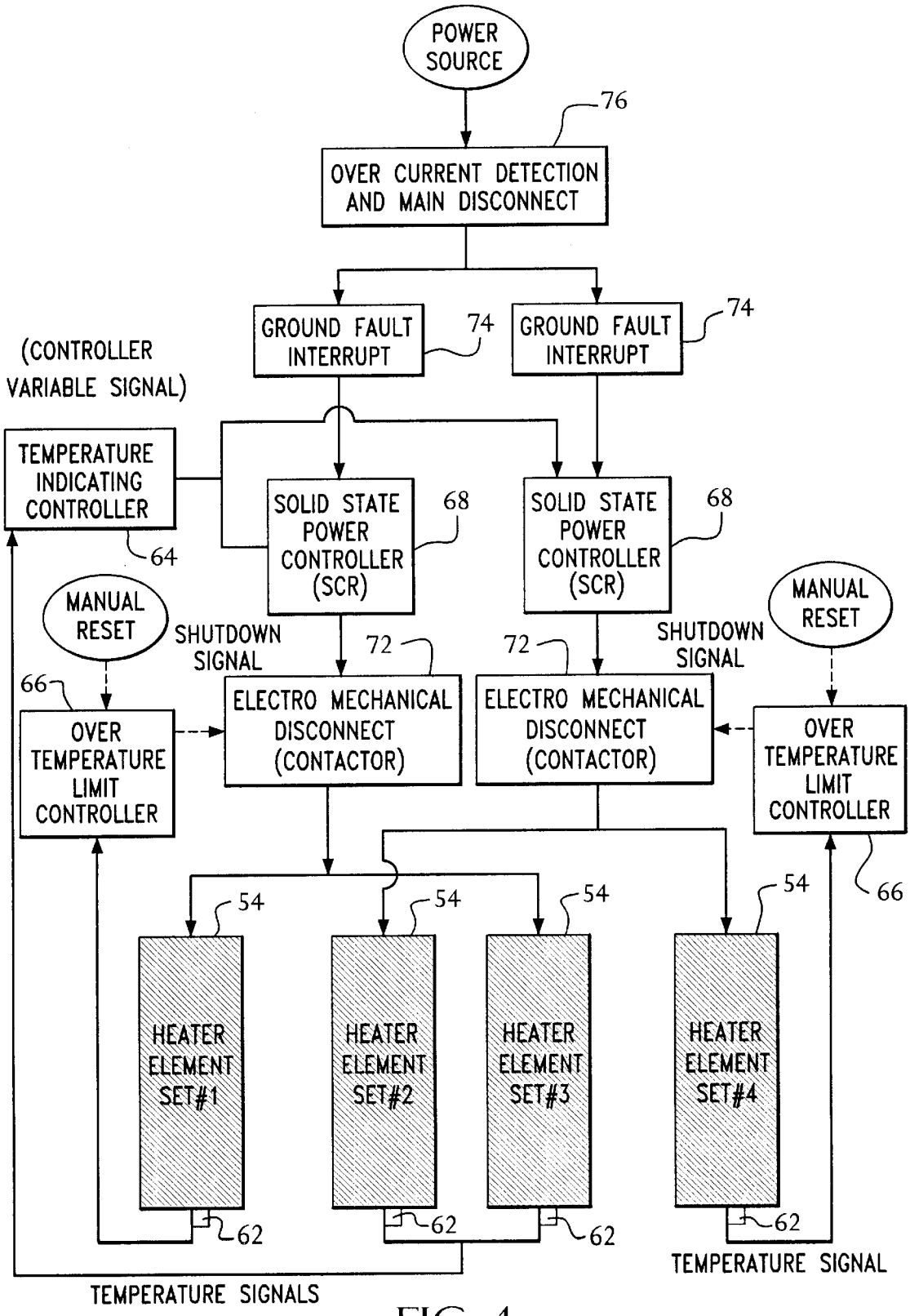
FIG. 4 is a flowchart of a system block diagram for use with the gas supply system of FIG. 1 or 2.

As can be seen in the preferred heating controller operational block diagram of FIG. 4, the heater controller 60 may preferably use a three mode temperature indicating controller (TIC) 64. The TIC 64 utilizes inputs from the temperature measurement elements 62. The failure mode is significantly reduced by utilizing multiple independent measurement elements. Feedback control is utilized to maintain the desired vessel surface temperature. The TIC, which preferably is the primary control layer, will preferably have three mode Proportional-Integral-Derivative (PID) control capability, and will provide a control signal to one or more solid-state power controllers 68. The power controller 68 will modulate the voltage to the heating elements 54 to maintain the desired surface temperature. In addition, a second layer of control will be integrated to monitor for a failure of the primary control layer, TIC 64. This layer will utilize a measurement element that is independent of that used for primary control. In the event the temperature of this protective circuit exceeds the preset limit, power to the heating elements 54 within a heating zone (e.g. 54, 56) will be removed by deactivating an electro-mechanical disconnect (contactor) 72. This circuit will remain deactivated until the monitored temperature falls below the defined setpoint and the system is, for example, manually reset. The heating system is designed to provide the highest degree of operating flexibility over a variation of supply voltages and operating frequencies.

Figure 3:
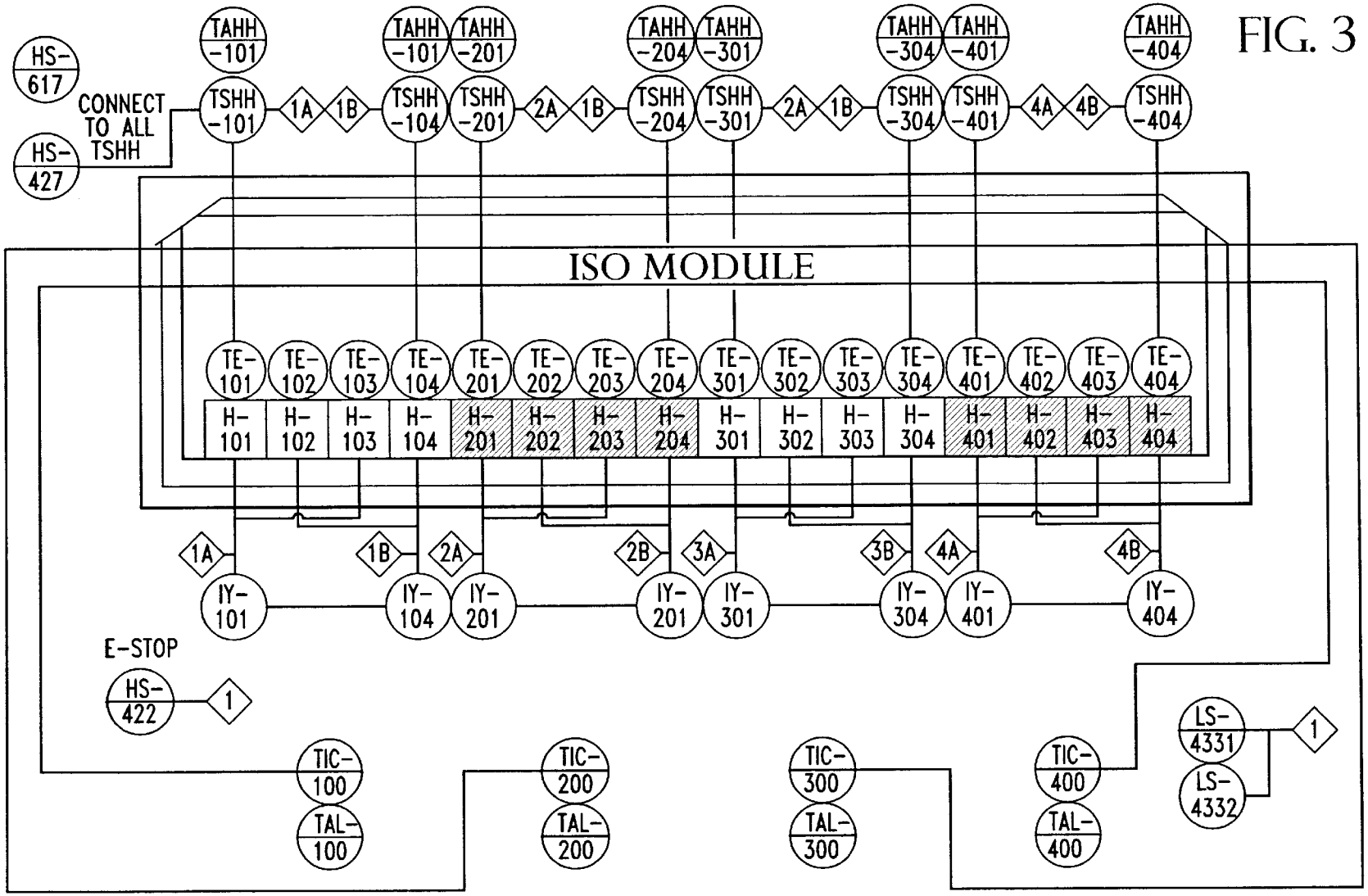
FIG. 3 is schematic diagram of an example of a heater controller for use with the gas supply system of FIG. 1 or 2.

As can be seen in the example of a system block diagram of FIG. 3, the heating elements 54 (here designated H-101 through H104, H-201 through H-204, H-301 through H-304, and H-401 through H-404 in four respective zones) and associated controls may be segregated into, for example, four distinct sections or zones with four resistive heaters per zone. All zones of control operate independently, maintaining the specified temperature within the zone. Over-temperature conditions within a zone impact only the operation of the associated zone.

Each zone of control is schematically depicted in FIG. 4 and has the following devices:

- four resistive heating elements 54 (e.g., Heater Element Set 1 which corresponds to H-101 to H-104, in FIG. 3);
- one temperature indicating controller 64 (e.g., TIC-100 in FIG. 3);
- two over-temperature limit controllers 66;
- two Silicone Controlled Rectifier (SCR) power controllers 68;
- two electro-mechanical disconnects (or contactors) 72;
- two over-current devices 76 with integral ground fault leakage detection 74;
- four temperature measurement elements, Type "K" thermocouples 62, integral to the resistive heater assembly;

To provide alarm management, a Programmable Logic Controller (PLC) 61 may be integrated into the control system. The PLC 61 is preferably utilized to "stage" the activation of heating elements 54, i.e, to stagger activation, to reduce the impact on the power grid that would result from the simultaneous activation of full power, e.g., 91,000 watts, of resistive heat.

The heating elements 54, with integral temperature measurement elements 62, are preferably permanently mounted on the vessel 20. These devices are preferably connected to the heater controller 60 through the use of cables assemblies utilizing multi-pin "quick-connect" electrical plug assemblies. This permits the replacement of an empty vessel 20 to be performed with minimal effort.

To describe the operation of the overall system herein, only one of the four zones at the device level will be described in detail herein. Each heat zone is substantially the same as that of the other zones; only the reference numbers are changed for identification purposes. For convenience herein, the one zone will be evaluated to fully describe the operation of the design.

Temperature control is accomplished through the use of a feedback control scheme. As can be seen in FIG. 4, the temperature indicating controller 64 is preferably a three-mode controller, utilizing proportional, integral, and derivative (PID) control. As seen in FIG. 3, a temperature controller corresponding to the first zone (TIC-100) monitors the temperature of the process, i.e., a process variable; in this case the surface of the vessel 20. This signal is compared to the desired temperature, a setpoint, and an output signal is generated from TIC-100 that is proportional to the difference between the measured and desired temperatures. This signal is sent to the final control element, in this case SCR power controller 68 (see FIG. 4), that manipulates the electrical energy supplied to the resistive heating elements 54 on the surface of the vessel 20.

For this example application, the temperature indicating controller (TIC-100) 64 monitors the temperature from, for example, two temperature measurement elements 54 connected in parallel, (TE-102 and TE-103). As a result, the controller receives an "averaged" temperature signal. Failure of one element does not effect the operation of the temperature controller. Only upon loss of the process variable signal from both elements will the controller inhibit the application of heat due to the integral "up-scale burnout" protection feature within the temperature controller. The two monitored elements are preferably located in adjacent heater assemblies, (e.g., H-102 and H-103). This minimizes the temperature gradient that could exist between two separate monitoring points on the vessel surface.

High-temperature protection is provided through the use of temperature limit devices. Two high temperature switches, (TSHH-101 and TSHH-104) each have a dedicated thermocouple element to monitor the temperature at the surface of the vessel. Exposure to temperatures in excess of, for example, 125 degrees Fahrenheit to the surface of the vessel is prohibited by these devices. Therefore, the high temperature limit switch will have a temperature setpoint less than the defined 125 degrees Fahrenheit threshold. Activation of the high temperature limit switch results in the removal of electrical energy from the associated heating elements 54 through the deactivation of a electro-mechanical disconnect (contactor) 72. Reactivation of the over-temperature interlock circuit may preferably only be accomplished through manual intervention.

To minimize the impact on the total heat energy available due to activation of a single high temperature interlock, each heat zone may be divided into, for example, two sections. Activation of a high temperature limit switch, e.g., TSHH-101, results in the loss of heat energy from resistive heaters H-101 and H-103. Activation of another high temperature limit switch, e.g., TSHH-104 results in the loss of heat energy from resistive heaters H-102 and H-104. Deactivation of heaters is preferably staggered to reduce the impact from a localized loss of heat. Impact on the overall system here is a 12.5% reduction in available heat capacity.

Degradation of the dielectric properties of the insulating material utilized on the resistive heating elements 54 over a prolonged period of time can cause a hazardous situation. The application of electrical energy to the surface of the vessel 20 can compromise the integrity of the container, resulting in the uncontrolled release of product. Gradual degradation of the insulating properties of the heater assembly is expected over a given period of time. The result of this degradation is the eventual creation of a path to ground for the electrical current. Although very small in magnitude with respect to the current passed through three phase conductors providing energy to the resistive heater element, this leakage is detectable. Therefore, as a protective measure, the over-current limit devices 76 selected have an integral ground-current leakage monitor that automatically disconnects power to the heating elements 54 in the event this leakage current exceeds, for example, 100 mA. These over-current devices 76 with integral ground fault leakage detection 74 are utilized on all circuit branches that feed power to the resistive heaters.

The same methodology utilized for the high temperature protection is utilized for the over-current and ground leakage protection interlocks. To minimize the impact on the total heat energy available due to activation of a single over-current/ground leakage interlock, the system utilizes the division of each zone into, for example, two sections. Activation of one of the ground fault leakage detectors 74, i.e., the tripping of a ground leakage circuit breaker (GFCB) results in the loss of heat energy from, for example, only two resistive heaters. The deactivated heaters are again staggered in the same way to reduce the impact from a localized loss of heat. Impact on the overall system is again a 12.5% reduction in available heat capacity.

The regulation of the electrical energy utilized by the resistive heating elements 54 is controlled through the use of solid-state power controllers 68 utilizing Silicone Controlled Rectifiers (SCR's). The power controllers (e.g., IY-101 and IY-104 in FIG. 3) receive the output signal from the temperature controller (TIC-100) and switch the voltage to their respective heaters at a high rate of speed. This high speed switching allows for the precise level of temperature control required for this application.

To minimize the impact on the total heat energy available due to failure of a SCR power controller, the system preferably utilizes the division of each zone into, for example, two sections. Loss of one of the SCR power controllers 68 results in the loss of heat energy from only two resistive heaters. The deactivated heaters are staggered, as noted previously, to reduce the impact from a localized loss of heat. Impact on the overall system is a again 12.5% reduction in available heat capacity.

When a load of significant capacity is connected to a power source, the impact of the additional load can adversely affect the power system. A way of introducing the resistive load in a controlled manner is desirable to minimize these effects. The PLC 61 is primarily utilized for alarm management, but the unit preferably has a significant degree of higher-level control including the capability to perform time-based sequences.

Preferably, for example, one half of each heat zone, e.g., 56, 58 is therefore enabled in a time based sequential manner by the PLC. When all alarms are cleared and the system is activated, for example, two out of four heating elements 54 in each zone are activated. A defined time interval later (for example, 30 seconds) the second set of elements in a first zone are enabled. This is followed by the activation of the second pair of elements in a second zone, for example, 30 seconds later. This is followed by the activation of the second pair of elements in a third zone and then a fourth zone.

Failure of the PLC does not inhibit operation of the system. All interlocks are hard-wired and do not require operation of the PLC. Again, a reduction of available heat capacity is realized, in this case 50%. Although this case is more severe than in any of those previously addressed, the system may be adapted to remain operational at this reduced capacity.

Low voltage control (24 VDC) is utilized within the control enclosure to minimize potential hazards within the system. Utilization of twenty-four volt power within a control system has been proven less susceptible to voltage sags within the incoming power supply due to the filtering capacitance integrated into the DC power supplies. This capacitance provides a degree of energy storage that can enable the system to remain operational through a "brown-out" condition. However, failure of this power supply could compromise system operation.

The system therefore preferably utilizes two DC power supplies, connected in a redundant fashion. Failure of either power supply does not impact the operation of the control system. Each power supply is monitored and, preferably, an alarm is activated to signal the loss of a supply.

Operating of SCR power controllers 68 can generate a significant amount of heat within the control enclosure. The system is designed to preferably utilize a closed loop air conditioner to maintain the temperature within the enclosure. This increases the reliability of the components and devices utilized in the system. A secondary measurement device is utilized to detect failure of the air conditioner unit by monitoring the temperature within the enclosure and generating an alarm in the event it exceeds a defined high limit.

To eliminate the potential hazard associated with an operator connecting or disconnecting the power cables from vessel 20 under power, interlocks are preferably installed on the doors that cover the "quick-connect" electrical plug assemblies on the vessel 20. If either of the two doors is opened, all electrical energy is removed from the interconnecting heater cable assemblies, and an alarm is activated.

Although illustrated and described herein with reference to specific embodiments, the present invention nevertheless is not intended to be limited to the details shown. Rather, various modifications may be made in the details within the scope and range of equivalents of the claims without departing from the spirit of the invention.

What is claimed is:

1. A high flow rate, transportable, ultra high purity gas vaporization and supply system, comprising:

(a) a vessel suitable for carrying large quantities of a liquefied gas;

(b) a plurality of valves adapted to operate with liquid or gas phases;

(c) a loading/unloading unit disposed on said vessel for loading and unloading the liquefied gas to be supplied;

(d) at least one heater containing a plurality of heating elements permanently positioned on the vessel to supply energy into the liquefied gas, said heater adapted to cause said liquefied gas to be supplied through said loading/unloading unit as a gas; and (e) a heater controller adapted to use process variables feedback for regulating said heating elements maintaining and regulating gas output.

2. The gas vaporization and supply system of claim 1, wherein the vessel is a vessel selected from the group consisting of ISO containers, tube trailers, and tankers.

3. The gas vaporization and supply system of claim 1, wherein the vessel is suitable for carrying over about 2,000 lbs. of the liquefied gas.

4. The gas vaporization and supply system of claim 1, wherein the vessel is suitable for carrying over from about 20,000 to 50,000 lbs. of the liquefied gas.

5. The gas vaporization and supply system of claim 1, wherein the vessel is covered with thermal insulation.

6. The gas vaporization and supply system of claim 1, wherein said plurality of heating elements are divided into a plurality of heating zones, each heating zone having at least one heating element.

7. The gas vaporization and supply system of claim 1, wherein said heater controller utilizes a plurality of temperature measurement elements to provide feedback to said heater controller.

8. The gas vaporization and supply system of claim 1, wherein said heater controller includes a programmable logic controller to stagger activation of said heating elements.

9. The gas vaporization and supply system of claim 1, wherein said heating elements are connected to said heater controller utilizing quick-connect electrical plug assemblies to permit replacement of an empty vessel with minimal effort.

10. The gas vaporization and supply system of claim 1, including at least one high temperature switch associated with said heating elements, wherein said switch includes a temperature set point where said switch is adapted to disconnect associated heating elements when said set point is reached.

11. The gas vaporization and supply system of claim 1, wherein said heating elements are grouped into a plurality of heating zones that are separately controlled by said heater controller.

12. The gas vaporization and supply system of claim 1, including a ground-current leakage monitor that is adapted to automatically disconnect power to the heating elements when leakage current exceeds a predetermined value.

13. The gas vaporization and supply system of claim 12, wherein the leakage monitor is adapted to automatically disconnect power to at least some of said heating elements when leakage current exceeds 100 mA.

14. The gas vaporization and supply system of claim 1, including an over current limit device that is adapted to automatically disconnect power to at least some heating elements when current exceeds a predetermined value.

15. The gas vaporization and supply system of claim 1, wherein said heating elements are located above a lowest expected vapor-liquid interface level thereby maximizing vapor phase purity.

16. A method for providing high flow rate, transportable, ultra high purity gas, comprising:

(a) providing a vessel suitable for carrying large quantities of a liquefied gas;

(b) providing a plurality of valves adapted to operate with liquid or gas phases;

(c) providing a loading/unloading unit disposed on said vessel for loading and unloading the liquefied gas to be supplied;

(d) providing at least one heater containing a plurality of heating elements permanently positioned on the vessel to supply energy into the liquefied gas, said heater adapted to cause said liquefied gas to be supplied through said loading/unloading unit as a gas;

(e) providing a heater controller adapted to use process variables feedback for regulating said heating elements maintaining and regulating gas output; and (f) controlling flow of said gas out of said vessel through said loading/unloading unit by said heater controller utilizing process variables feedback to regulate said heating elements.

* * * * *